US005791254A

United States Patent [19]

Mares et al.

[11] Patent Number: 5,791,254

[45] Date of Patent: Aug. 11, 1998

[54] FULL RANGE OF MOTION ROLLER COASTER

[75] Inventors: John F. Mares; Robert H. Gorman, both of Albuquerque, N. Mex.

[73] Assignee: Meteoro Amusement Corporation, Albuquerque, N. Mex.

[21] Appl. No.: 742,465

[22] Filed: Nov. 1, 1996

[51] Int. Cl.[6] ..... A63G 31/00

[52] U.S. Cl. ..... 104/53; 104/76; 104/55

[58] Field of Search ..... 104/53, 55, 56, 104/57, 58, 62, 63, 64, 65, 66, 74, 75, 76, 77, 78; 105/149.1, 149.2

[56] References Cited

U.S. PATENT DOCUMENTS

| | | | |
|---|---|---|---|
| 142,605 | 9/1873 | Yates . | |
| 567,861 | 9/1896 | Mustain . | |
| 728,246 | 5/1903 | Kremer . | |
| 771,322 | 10/1904 | Pattee . | |
| 803,465 | 10/1905 | Bernheisel . | |
| 815,210 | 3/1906 | Pattee . | |
| 815,211 | 3/1906 | Pattee et al. . | |
| 887,082 | 5/1908 | Fraser . | |
| 901,435 | 10/1908 | Fuller . | |
| 944,407 | 12/1909 | Beebe . | |
| 995,945 | 6/1911 | Berhold . | |
| 1,783,268 | 12/1930 | Traver | 104/76 |
| 2,009,904 | 7/1935 | Purves . | |
| 2,135,230 | 11/1938 | Courtney | 104/76 |
| 2,498,450 | 2/1950 | Pewitt | 104/76 |
| 2,499,470 | 3/1950 | Duncan | 104/76 |
| 2,535,862 | 12/1950 | Pewitt . | |
| 3,066,951 | 12/1962 | Gray . | |
| 3,299,565 | 1/1967 | Yarashes . | |
| 3,507,222 | 4/1970 | Cirami . | |
| 3,610,160 | 10/1971 | Alimanestianu | 104/88 |
| 3,777,835 | 12/1973 | Bourne | 180/10 |
| 4,170,943 | 10/1979 | Achrekar | 104/56 |
| 4,221,170 | 9/1980 | Koudelka | 104/63 |
| 4,272,093 | 6/1981 | Filice et al. | 280/206 |
| 4,501,434 | 2/1985 | Dupuis | 280/206 |
| 4,545,574 | 10/1985 | Sassak | 272/6 |
| 5,218,910 | 6/1993 | Mesmer et al. | 104/57 |

FOREIGN PATENT DOCUMENTS

| | | | |
|---|---|---|---|
| WO 91/13662 | 9/1991 | WIPO | 104/53 |
| WO 93/24196 | 12/1993 | WIPO | 104/93 |

OTHER PUBLICATIONS

Throgmorton, Todd H., "An Illustrated Guide to the Rides in the United States and Canada, with a History," McFarland & Company, Inc., 1962.

*Primary Examiner*—Mark Tuan Le

*Attorney, Agent, or Firm*—Deborah A. Peacock; Jeffrey D. Myers

[57] ABSTRACT

A roller coaster or amusement park ride. The roller coaster comprises a track system capable of any directional travel, including horizontal, vertical, angled, curved, curvilinear, and retrograde directions. A carriage in which passengers reside is rotatable about the track system, either by programming or by passenger activation, providing for additional freedom of movement. The roller coaster may have a track through a clear tube (e.g., surrounded by water) and multiple, independent rides supported by the same support structure, providing increased excitement for the passengers.

24 Claims, 15 Drawing Sheets

FULL RANGE OF MOTION ROLLER COASTER

CROSS-REFERENCE TO RELATED APPLICATIONS

This application claims the benefit of the filing of Provisional application Ser. No. 60/007,206, entitled "Amusement or Basic Transportation Device Using a Ball (Sphere) and Track or Tube", filed on Nov. 3, 1995, which is incorporated herein by reference.

BACKGROUND OF THE INVENTION

1. Field of the Invention (Technical Field)

The present invention relates to amusement apparatuses, particularly roller coasters.

2. Background Art

Since the early days of roller coasters, people have experimented with variations of a central theme, which is to provide amusement to riders seated inside cars which travel along tracks. Traditional roller coaster cars travel along double rail tracks and provide their riders with stationary seats or harnesses which fix the motion of the riders to the direction of travel of the cars. The overall effect attained by traditional roller coasters is to statically couple riders to their cars and therefore sense essentially the same motions and gravitational forces experienced by the cars in which they ride. These roller coasters also fail to allow their riders the option of when and where the riders can independently elect to either isolate their movements or attach their movements to the cars in which they ride. Further, such devices fail to provide for free fall, retrograde motion or helical motion.

Some devices pretend to deliver a second degree of rotation through the use of cylinders or spheres, which roll on tracks, such as described in U.S. Pat. No. 142,605, to Yates, entitled "Pneumatic Railway Cars", and U.S. Pat. No. 567,861, to Mustain, entitled "Means for Transportation." The Yates device allows passengers and freight to roll along railroad tracks placed inside a box tube, propelled by an air current. The Yates device isolates the motion of travel of the inner compartment from the rotation of an outer cylinder but fails to provide a brake which acts to affix the motion of the inner compartment to the outer cylinder, fails to provide for free fall, retrograde motion or helical motion of the cylinder and fails to provide for multiple passenger compartments in a train of cylinders. The Mustain device allows for the transportation of goods along horizontal, parallel rails, such as a railroad. The Mustain device provides for the goods transported therein to travel in a plane separate from the motion of the overall car, but fails to isolate the travel of goods placed inside the spheres from the motion of the spheres, delivering an effect similar to the travel of clothes within a clothes dryer. Such a system is clearly unsuitable for the transportation of fragile items and passengers.

U.S. Pat. No. 728,246, to Kremer, entitled "Exhibition Apparatus," provides for passenger travel within a rolling ball, or sphere, along two horizontally disposed rails. The Kremer device isolates the internal passenger from the spin of the outer ball through the use of a journal. U.S. Pat. No. 771,322, to Pattee, entitled "Ball Coaster", provides for passenger travel within a sphere which travels upon a vertically inclined, but horizontally flat, path. U.S. Pat. No. 803,465, to Bernheisel, provides for a passenger seat situated within a wheel which travels between vertically opposed rails. U.S. Pat. No. 815,210, to Pattee, entitled "Spherical Amusement Vehicle", consists of a passenger compartment in the shape of a cup which is suspended within a sphere. The Pattee device travels along two horizontal rails and has a cog which runs along the central circumference of the sphere. U.S. Pat. No. 815,211, to Pattee et al., entitled "Amusement Vehicle", depicts a passenger cabin within a sphere which rests and/or rolls upon a carriage which rests and or propels itself upon two horizontal rails. The Pattee, et al., carriage device actively rolls the sphere but fails to allow travel of the carriage substantially past level. U.S. Pat. No. 887,082, to Fraser, entitled "Amusement Device", provides for a passenger compartment within a ball with hand rails for the passengers. The Fraser device fails to provide a track or rails which guide the ball. U.S. Pat. No. 901,435, to Fuller, entitled "Amusement Device" provides for a passenger compartment within a cylinder which rolls upon two horizontal rails. U.S. Pat. No. 944,407, to Beebe, entitled "Amusement Device", provides for a passenger compartment within a sphere which rolls upon a vertically inclined, but horizontally flat, path. U.S. Pat. No. 995,945, to Berhold, entitled "Amusement Device", provides for a passenger compartment within a cylinder which rolls upon a vertically inclined, but horizontally flat, track which lies between two horizontally opposed rails, which are used to guide the cylinder. U.S. Pat. No. 2,009,904, to Purves, entitled "Vehicle", provides for a passenger compartment within an annulus of a sphere which propels itself along the ground. The Purves device fails to provide a track or rails which guide the annulus. U.S. Pat. No. 2,535,862, to Pewitt, entitled "Vertical and Horizontal Axes Roundabout", provides for a passenger compartment suspended within a spheroidal framework which is either vertically attached to a merry-go-round device or which rests upon trucks in order to roll along two horizontal rails. U.S. Pat. No. 3,610,160, to Alimanestianu, entitled "Transport System", provides for a passenger compartment within a cylinder which rests atop a frame which propels itself between two support rails and two guide rails. These references fail to allow the passenger to utilize a brake which would act to affix the motion of the inner compartment to the outer carriage.

None of these devices provide for free fall, retrograde or helical motion of the carriage. Most of the references do not provide for multiple passenger compartments in a train of carriages.

U.S. Pat. No. 3,066,951, to Gray, entitled "Rolling Sphere Having Means for Accommodating an Occupant Therewithin", provides for a passenger compartment within a sphere which rolls along the ground or floats on water. The Gray device fails to isolate the passenger from the motion of the sphere and fails to provide a track or rails which guide the sphere. U.S. Pat. No. 3,299,565, to Yarashes, entitled "Electro-Magnetic Transport System", provides for a sphere which is propelled by and along a roughed track by means of electromagnets. The Yarashes device fails to isolate payloads or passengers from the motion of the sphere and fails to isolate the inner compartment from the outer sphere. U.S. Pat. No. 3,777,835, to Bourne, entitled "One Wheeled Vehicle", provides for a passenger compartment within a hoop which propels itself along the ground. The Bourne device does not provide a track or rails which guide the hoop. U.S. Pat. No. 4,272,093, to Filice et al., entitled "Self-Propelled Rolling Toy", provides for a passenger compartment within a sphere which rolls inside a walled enclosure. The Filice, et al., device fails to isolate the passenger from the motion of the sphere, fails to provide a track or rails which guide the sphere. U.S. Pat. No. 4,501,434, to Dupuis, entitled "Vehicle for a Fun-Fair or the Like", provides for a passenger compartment within a sphere which rolls along the ground or floats on water. The Dupuis device fails to provide a track or rails which guide the sphere.

U.S. Pat. No. 3,507,222, to Cirami, entitled "Robot Ride", provides for transportation of passengers in a spheroidal compartment which sits atop a walking robot device. The Cirami device walks rather than rolls and therefore is not a roller coaster type of device. U.S. Pat. No. 4,545,574, to Sassak, entitled "Fluid Suspended Passenger Carrying Spherical Body Having Universal Attitude Control", provides for a passenger compartment within a sphere is which is sucked up inside a tube wherein it floats in a relative vacuum. The Sassek device is not a roller coaster-type device in as much as it does not roll on anything but rather is suspended in air.

*Roller Coasters, an Illustrated Guide to the Rides in the United States and Canada, with a History*, by Throgmorton, 1993, provides illustrations and examples of roller coaster devices which are currently in use or which are being tested for use. Several examples of devices exhibit helical motion, such as the "Corkscrew,"(p.27), the "Pipeline prototype," (p. 35), the "Vortex," (p. 85), the "Carolina Cyclone," (p. 98), and the "Ultra Twister," (p. 110). These devices all statically fix their riders to the motion of the cars in which they travel. Some devices allow for travel of passenger cars within tunnels, such as the "Beast," (p. 83) and some even allow for travel through tunnels which are set into pools of water, such as the "Anaconda," (p. 116). None of the devices listed by Throgmorton allow for independent rider control of motion about a pivot, for free fall, or for retrograde motion, or for travel through clear tubes.

SUMMARY OF THE INVENTION (DISCLOSURE OF THE INVENTION)

The present invention is a roller coaster comprising: a carriage supporting a frame, the frame comprising a seat for seating at least one passenger riding the roller coaster; a pivot connecting the carriage and the frame, the pivot allowing the frame to pivot within the carriage; a track upon which the carriage rides, the track capable of going in any direction of horizontal, vertical, angled, retrograde, curved, and curvilinear; and a carriage contact for disposing the carriage on the track. In the preferred embodiment, at least one of the carriage and the frame is in a rectangular configuration. Alternatively, at least one of the carriage and the frame is in a spherical configuration.

The frame preferably has a restraint for restraining the passenger in the seat, most preferably a rigid bar and/or a flexible strap. The seat preferably seats multiple passengers. The seat is preferably contoured to the shape of the passenger(s). The carriage contact comprises sets of carriage wheels and the track is disposed between each set of the carriage is wheels (preferably, the carriage wheels are concave-shaped and the track is tubular).

The roller coaster preferably has a frame/carriage brake system for braking rotation of the frame relative to the carriage. The system may be activated by one or more passengers, only by more than one passenger, or only by a majority of passengers, depending on the desired ride parameters. The system preferably comprises a passenger pull lever, a disk brake, and calipers which engage with the disk brake when the passenger pulls on the lever. Alternatively, the frame/carriage brake system is automatically activated by a motor, preferably programmable.

The roller coaster may comprise multiple carriages attached to each other via rotatable couplers, preferably with three degrees of rotational freedom and preferably comprising linked u-joints. The pivot allows the frame to rotate up to and including 360 degrees about the carriage.

The roller coaster may comprise a clear tube in which at least a portion of the track is disposed, surrounded by a fluid or a solid. The carriage may be a sphere comprising a circumferential groove, with the track comprising parallel rails corresponding to and disposed within the groove. The roller coaster may then comprise a spherical-shaped frame disposed within the carriage providing for free movement of the frame sphere within the carriage sphere.

The roller coaster may comprise at least two track systems, each of the track systems supporting an independent roller coaster ride.

The invention is also of a roller coaster comprising: a carriage comprising a seat for seating at least one passenger riding the roller coaster; and a clear tube in which at least a portion of the roller coaster is disposed. The clear tube is surrounded by a fluid or a solid, and has a track disposed within it.

The invention is additionally of an amusement park ride comprising: a support structure for supporting at least two roller coaster systems; one roller coaster system disposed on the support structure; and at least one additional roller coaster system disposed on the same support structure, each of the roller coaster systems being independent rides.

The invention is yet further of a roller coaster comprising: a spherical carriage comprising a seat for seating at least one passenger riding the roller coaster; and a track in which the spherical carriage rotates on three axes of rotation. The track is preferably U-shaped or tubular.

It is a primary object of the present invention to provide a roller coaster or amusement park ride which allows for travel in any direction and providing full range of motion, such as horizontal, vertical, angled, curved, curvilinear, and retrograde directions/motions.

It is another object of the present invention to provide a roller coaster with free pivoting of the passenger(s) relative to the track.

Yet another object of the present invention is to provide a roller coaster with a frame to carriage braking system, which can be automated or activated by the passengers, with activation by the passengers on a "voting" basis or majority basis.

A further object of the present invention is to provide multiple roller coaster systems supported by the same structure, but independent rides.

Yet another object of the present invention is to provide for a roller coaster ride which passes through a clear tube in a fluid or solid.

Another object of the present invention is to provide for a sphere within a sphere roller coaster system and a sphere within a u-shaped tube (e.g., bobsled track) configuration.

A primary advantage of the present invention is that any direction is achieved, including difficult directions of vertical and retrograde.

Another advantage of the present invention is that the passenger may control the amount of pivoting via a passenger brake system.

Still another advantage of the present invention is that enhanced passenger throughput can be achieved using multiple carriages, multiple seats within each carriage, and even multiple track systems supported by a single support structure.

Another advantage of the present invention is that up to three degrees of freedom are achievable with the track, carriage and pivot systems incorporated into the roller coaster.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

(Best Modes for Carrying Out the Invention)

The present invention is of a roller coaster in which the occupants have a free range of motion in one or more axes. In the preferred embodiment, the range of free motion is in a single axis about a pivot or swivel. In an alternate embodiment in which a sphere within a sphere is employed, the range of free motion can be about an unlimited number of axes. Roller coasters according to the invention may be designed with vertical down sections (including free fall), vertical up sections, retrograde (negative or backwards) motion sections, and the like, which have heretofore not been possible, along with more traditional sections (e.g., curved, horizontal, curvilinear, spiral, loop, etc.). The roller coaster can also travel from an inside curve to an outside curve or from an outside curve to an inside curve. Additionally, the roller coaster can travel in a spiral or helix from up to down or from down to up, the spiral being situated at any attitude from vertical to horizontal. The carriages are propelled on rails or track either by push systems (not shown) or by the use of gravity and centrifugal forces.

Figure 1:
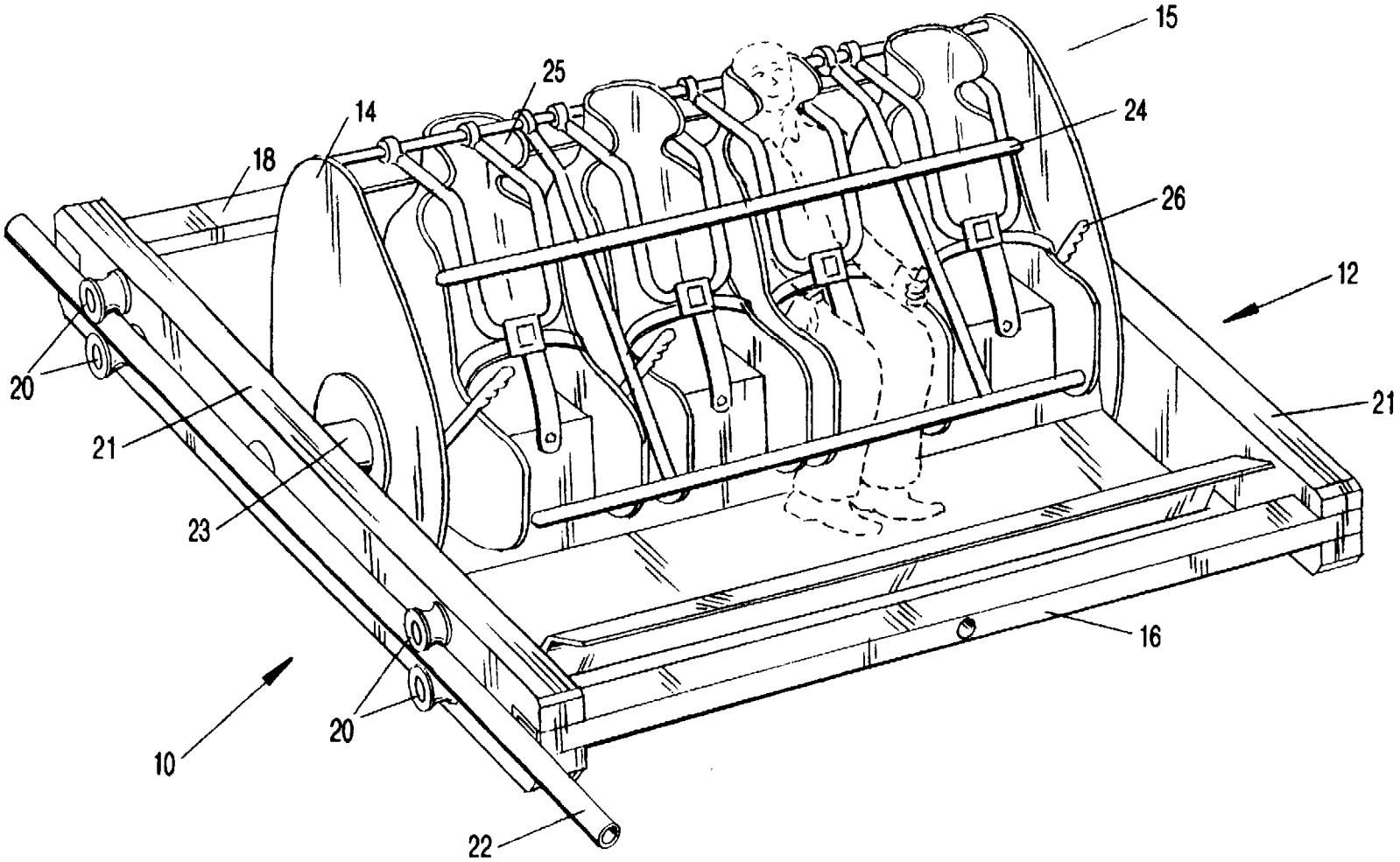
FIG. 1 is a perspective view of the preferred carriage of the invention.

FIG. 1 shows the preferred carriage and frame assembly 10 of the invention. Carriage 12, comprising sides 21, front bar 16, and back bar 18, engages tracks or rails 22 on either side of the carriage with carriage wheels 20. Car 15 comprises frame 14 and one or more seats 25 in which occupants are seated and restrained by restraints 24.

Passengers can sit or stand side by side or in line or in a triangle, pentagon or other configurations. Access to carriage by passenger(s) may be via front, side or other opening.

Seats can be positioned to face one or several directions. Restraints and seats may be of any type known to the art, taking into account that the riders may be upside down and moved sideways at times. Thus, restraints may be rigid (e.g., bars) or flexible (e.g., straps). Likewise, the seats may be contoured, provided with padding, bracing, support, and the like, to provide for passenger comfort and safety. The terms "seat," "seating means" and "seating," as used throughout the specification and claims, are intended to mean the passenger carrier for sitting or standing or being in a prone position, that is the position in which the passenger rides the roller coaster or amusement park ride, and is not limited to the common meaning of "seat"; but rather that the passenger is "seated" or disposed within the carriage or frame of the roller coaster.

Figure 2:
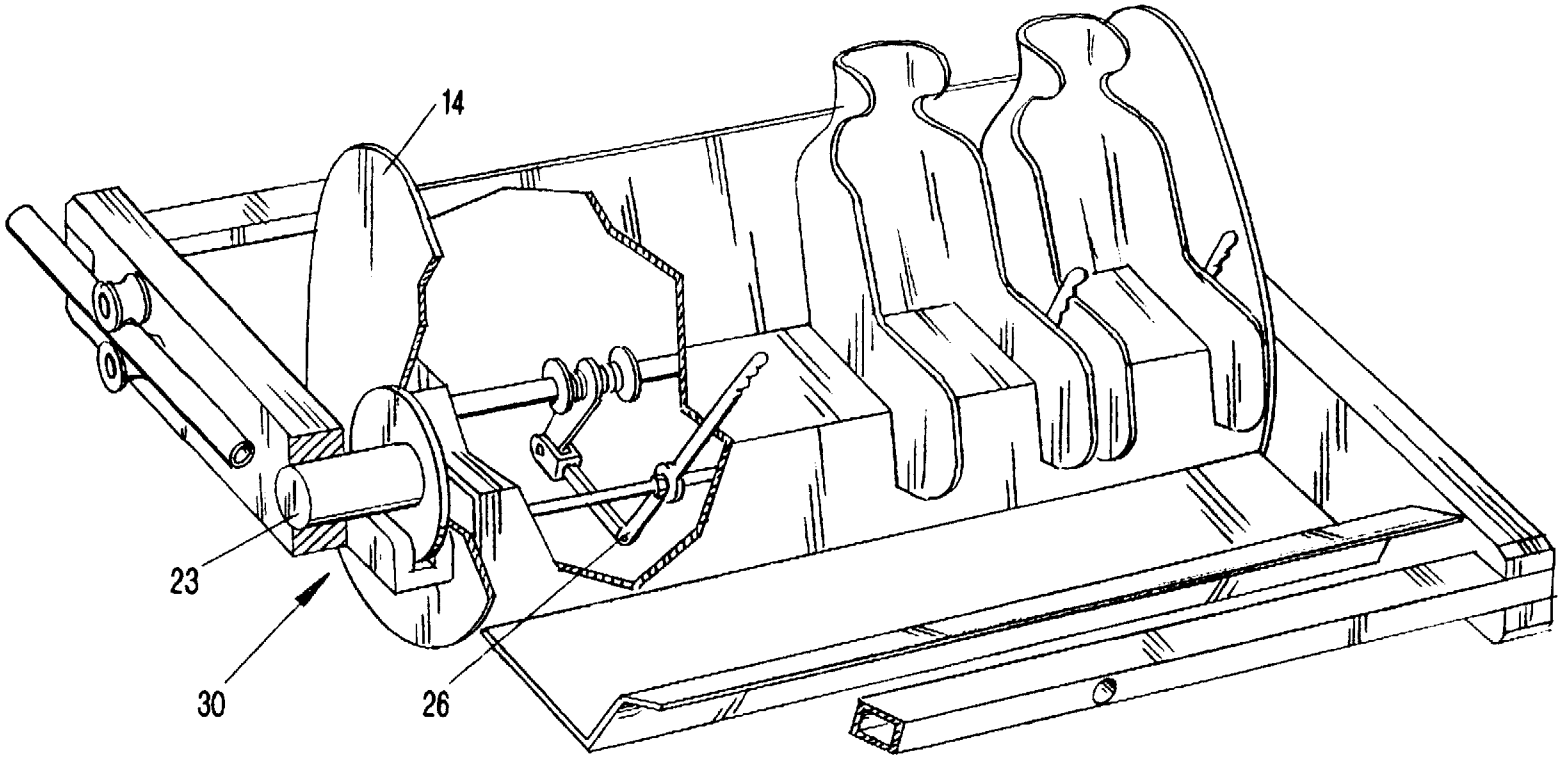
FIG. 2 is a cut-away view of the carriage of FIG. 1 illustrating the preferred pivot and frame/carriage brake systems.
Figure 3:
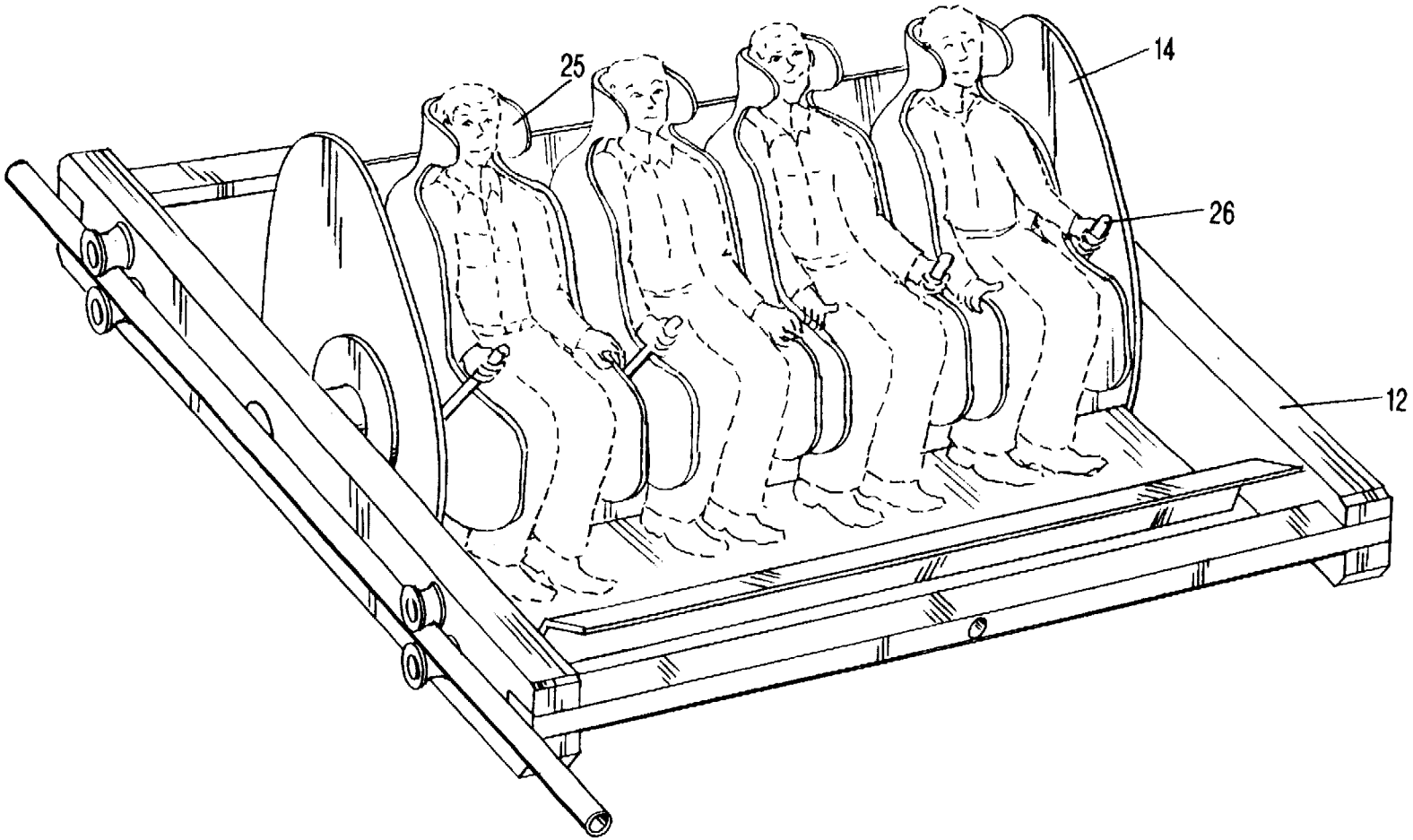
FIG. 3 illustrates the carriage of FIG. 1 when in use by four occupants.

Frame 14 rotates freely about rider seat rotation shaft 23. Sufficient clearance is provided between carriage 12 and car 15, this allows car 15 to spin, swing or rotate in a full or partial circle along an axis which runs between carriage 12. The occupants may modify the free rotation using frame to carriage brake handles 26, as described below. FIG. 2 shows the carriage and frame in cut-away view to show rotation and brake system 30. FIG. 3 shows carriage 12 and frame 14 with all four seats 25 occupied by riders ready to employ the brake handles 26.

Figure 4:
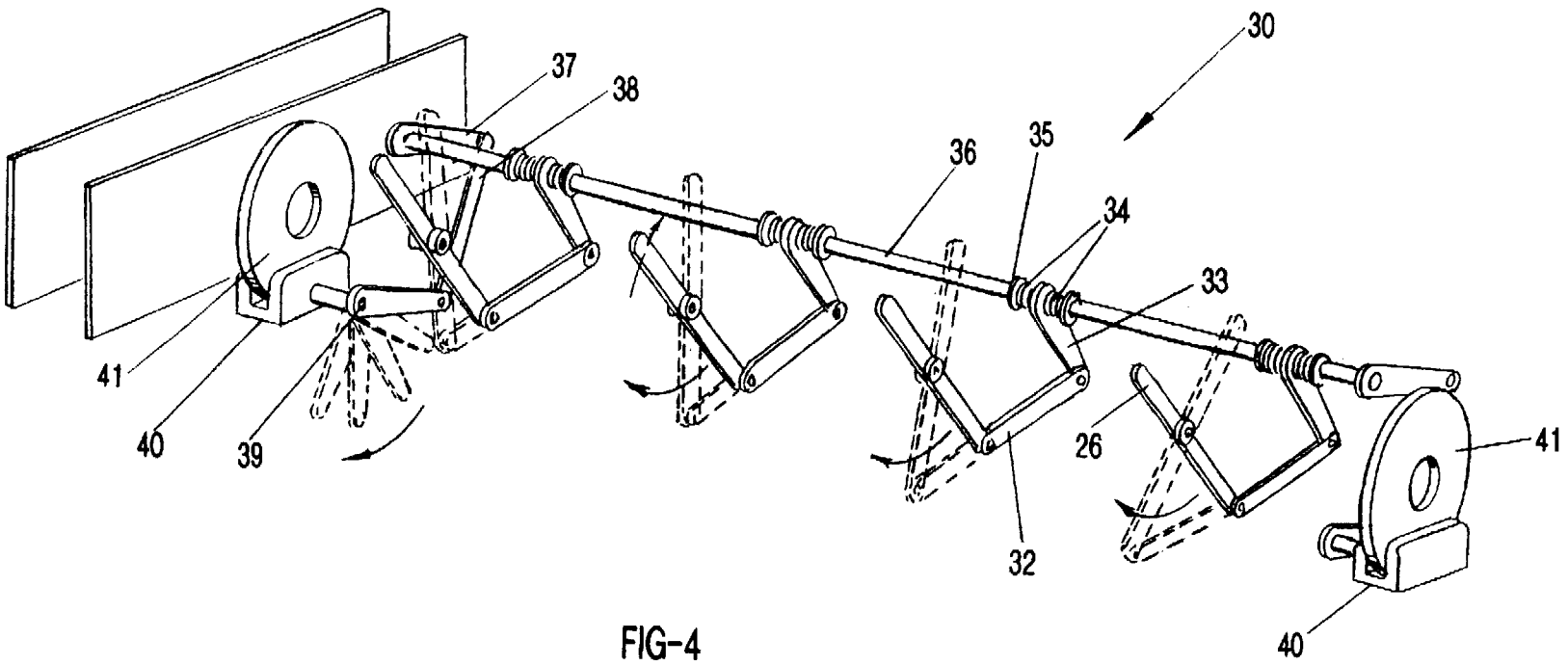
FIG. 4 illustrates the preferred frame/carriage braking system of the invention.
Figure 5:
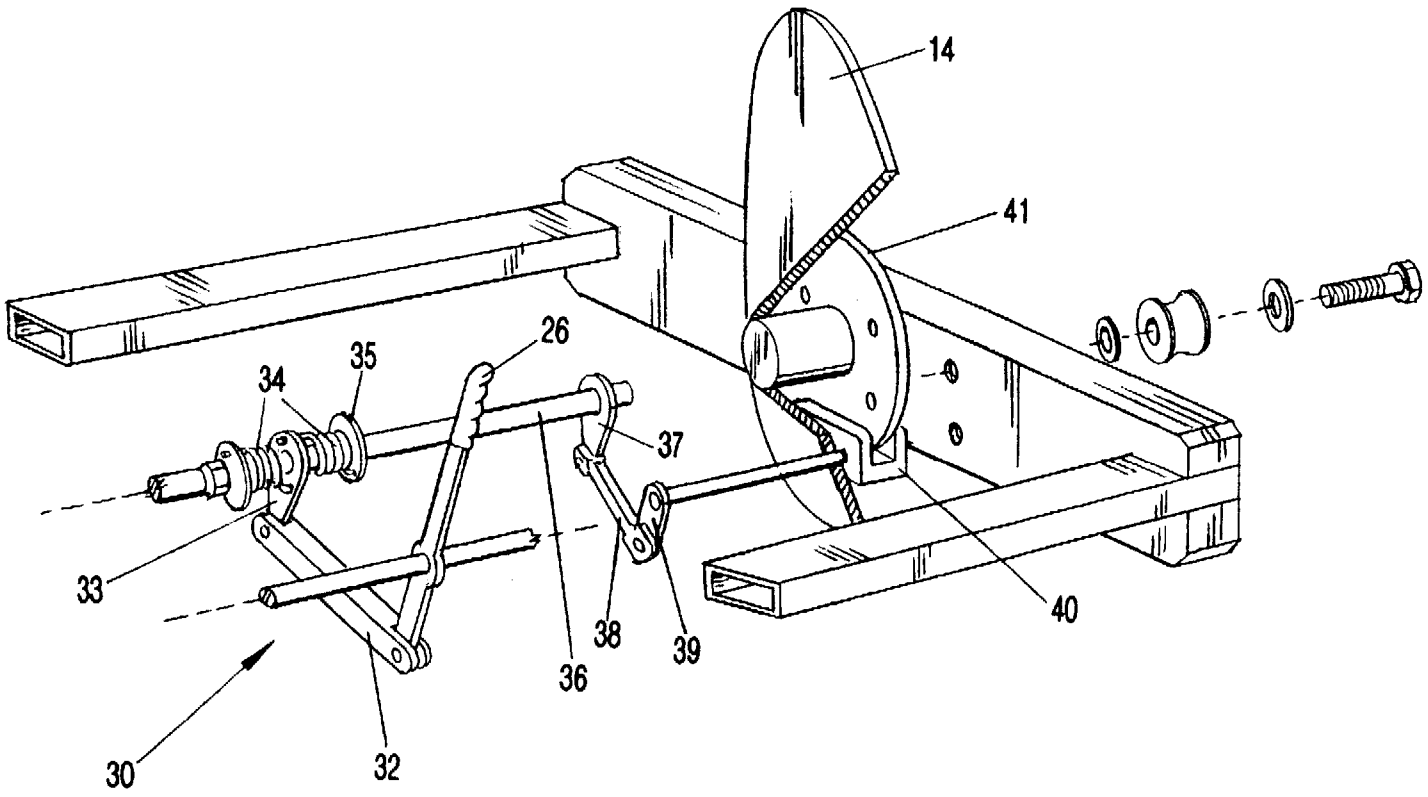
FIG. 5 is an exploded view of the brake system of the invention.

FIGS. 4 and 5 illustrate the preferred rotation and brake system 30 of the invention. The rotation and brake system permit rotation and position of frame 14 to be controlled by a rider or riders applying input through brake handle 26. The system may be set up so that a single rider applying input will cause braking. However, it is preferred that partial or full braking be based on multiple riders, or a majority, or polling of the riders input through the brake handles. FIG. 4 shows various adjustment positions in dashed lines, depending on the number of brake handles 26 pulled. The brake can be set by adjustment of force adjusting collar 35. The rotation and brake system can be locked to preclude rider input as to the rotation of frame 14 by locking actuating shaft 36. Enhanced reliability is provided through the incorporation of dual coupling springs 34, dual brakes 40, and brake discs 41.

The following occurs when a rider pulls a brake handle 26. Link 32 transmits the rider input motion to input transfer crank 33. The input transfer crank's position is converted to a torque force by coupling spring 34. The coupling spring torque force is transmitted to actuating shaft 36 by force adjusting collar 35, causing actuating shaft 36 to rotate. The actuating shaft rotation causes dual output cranks 37 to rotate, moving transfer link 38, causing brake input crank 39 to rotate. The rotation of the brake input crank causes brake 40 to exert a retarding force on brake disc 41. Brake disc 41 is fixed to carriage 12. A change in the pitch axis of frame 14 results in a pitch motion torque force exerted to car 15. The pitch motion torque force causes car 15 to follow the frame pitch motion. Car 15 will continue to follow the car pitch motion up to the limit of the retarding force exerted by the brake.

Alternative carriage/frame brake mechanisms can be provided, such as the use of a button, foot pedal, etc.

Figure 6:
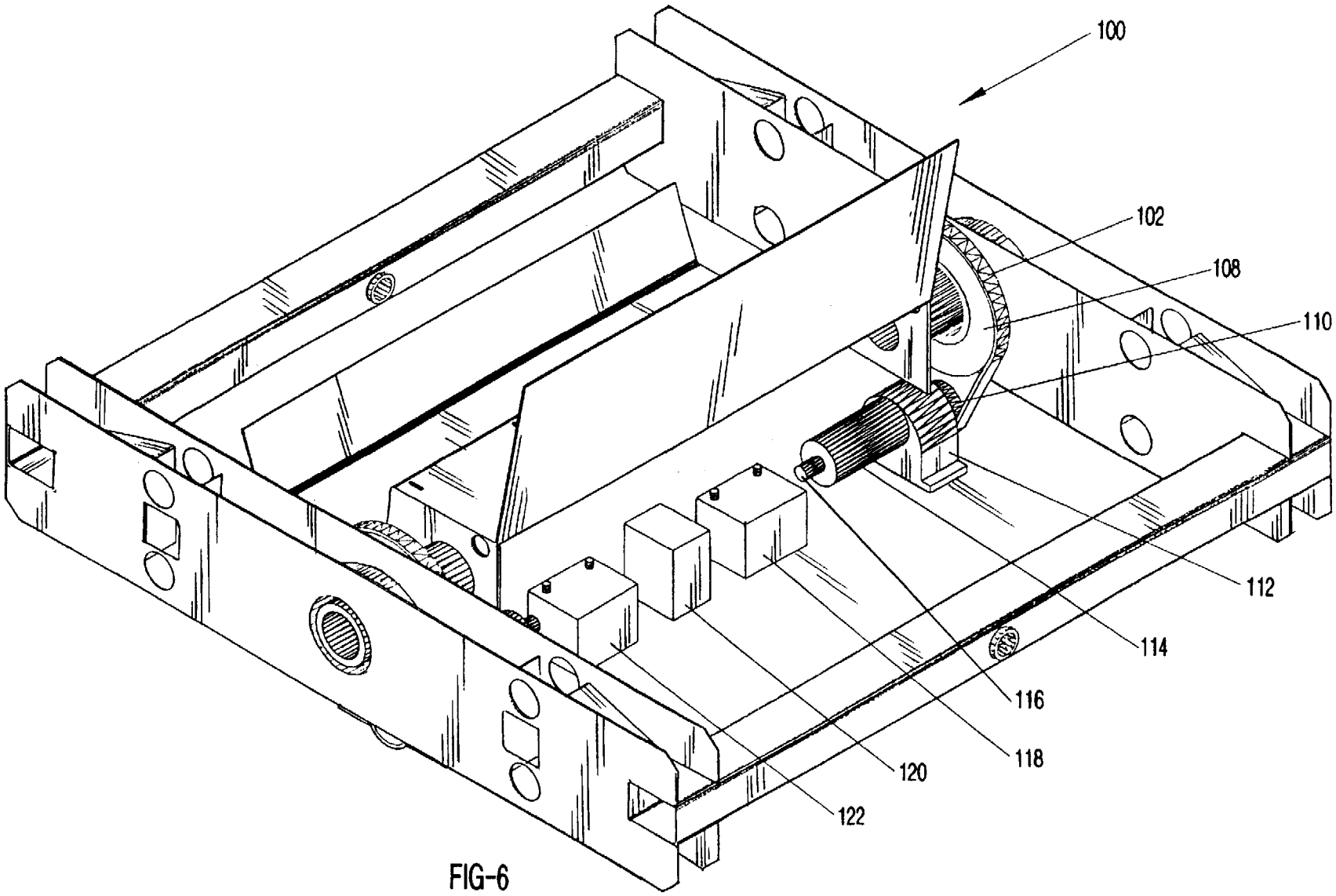
FIG. 6 illustrates an alternative programmable motorized occupant position control of the invention.

FIG. 6 illustrates the optional occupant seat programmed pitch axis control system 100 (OSPPACS) of the invention. The OSPPACS displaces the occupant seat about the car's pitch axis according to the programmed instructions issued by the onboard computer within drive controller 120 and servo or open loop drive system as a function of drive location. The OSPPACS maintains car location along the ride track by communicating with position transmitters/antennas (not shown) placed at intervals (preferably regular) along the length of the track. The OSPPACS allows for variations in the ride experience fitting the desires of the occupant(s). It may be programmed to maintain the optimum occupant pitch position during a ride to minimize occupant stress and allowing for the highest ride transitional velocity. It can control the occupant car angular pitch rate. The OSPPACS is preferably disabled upon the loss of the location reference signal, allowing the occupant seat to assume its free axis pitch position.

The seat pitch axis is preferably controlled by commands stored within interchangeable preprogrammed memory modules (not shown). Variations of the ride experience as to the degree of occupant seat position and pitch axis angular rate can be selected as determined suitable by the ride operator. The OSPPACS preprogrammed memory module may contain passwords allowing for OSPPACS operation only with a specific car and operator.

In operation of OSPPACS, the occupant pitch seat position begins in an initial position permitting passenger boarding. The operator selects the type of ride, which loads the preprogrammed instructions from the memory module into the OSPPACS memory. The ride is released, activating the track position transmitters/antennas. The car's translation motion causes the OSPPACS receiver within the drive controller 120 to pass a track position transmitter/antenna. The OSPPACS computer commands the occupant seat pitch axis drive motor 114 to rotate the occupant seat to the preprogrammed angular position at the preprogrammed angular rate. The OSPPACS computer commands the occupant seat pitch axis drive motor along the car ride track according to the car location as indicated by the position transmitters/antennas.

When the ride is in motion, the OSPPACS operates as follows: A signal is received from the track-mounted position transmitter/antenna. The position transmitter/antenna is coded as to its specific location on the track. The OSPPACS computer derives the occupant seat angular position and angular rate of motion from the preprogrammed memory instruction based on the car's specific track location. The OSPPACS computer commands the occupant seat drive motor to rotate to the specified angular position and at the specified angular rate. The angular position and rate is followed by the motor-mounted position sensor 116. The OSPPACS rotates the occupant seat to the specific angular position and at the specified angular rates at each successive track-mounted position transmitter/antenna. Loss of the track-mounted position transmitter/antenna signal, or the receipt of a non-valid signal, preferably causes a coupling clutch (not shown) or the like to disengage, allowing the occupant seat to resume the normal pitch axis position. The output of the drive motor is applied to a gearbox 112 which increases the torque available to rotate the occupant seat. The coupling clutch couples the gearbox to the small timing belt pulley (driving) 110 when commanded by the OSPPACS computer. The driving pulley transmits torque to the fixed timing belt pulley (driven) 108 through a timing belt 102. The driven timing belt pulley is fixed to the track-mounted car truck frame. A separate position sensor 116 is mounted which determines the absolute position of the timing belt. The car truck frame provides the kinematics grounding reference for the occupant seat angular position. OSPPACS power is preferably provided by batteries 118 and 122.

Figure 7:
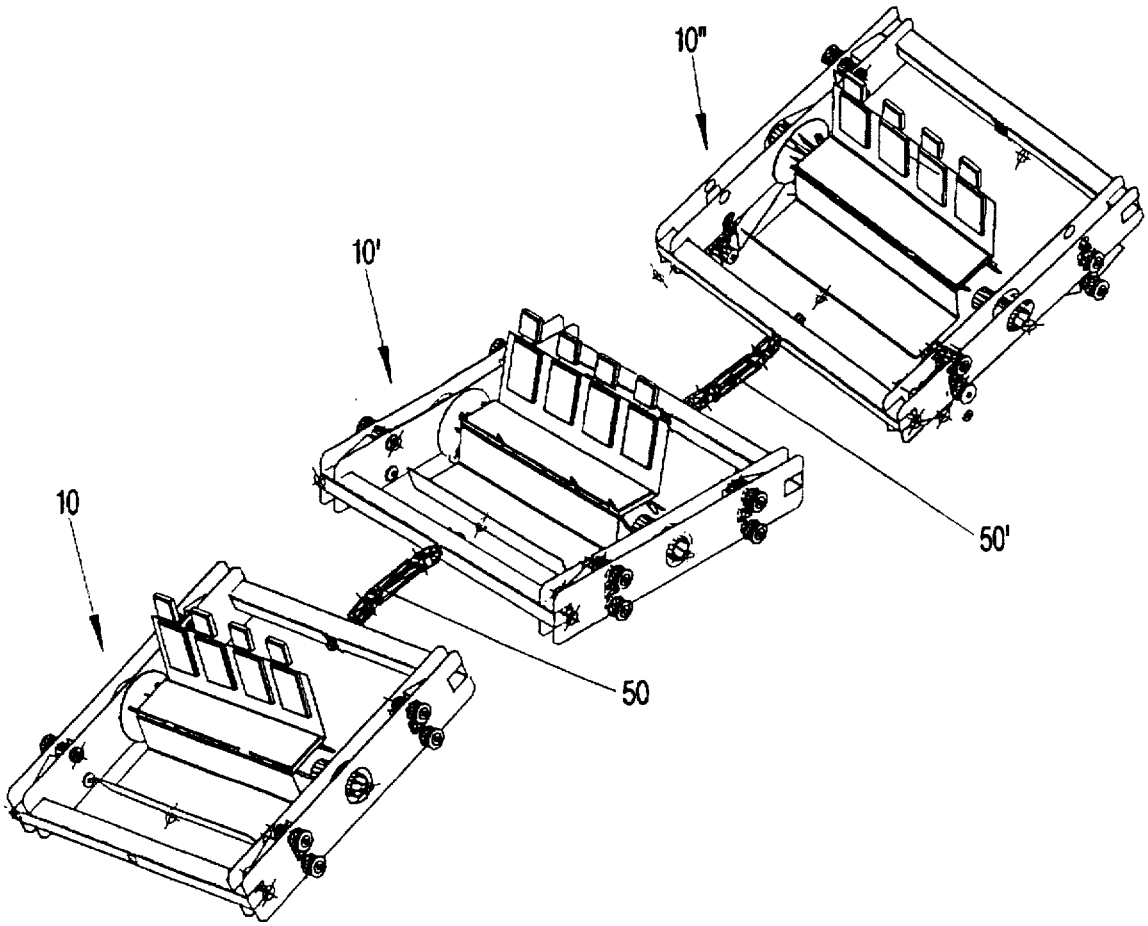
FIG. 7 illustrates the multiple-carriage embodiment of the invention.
Figure 8:
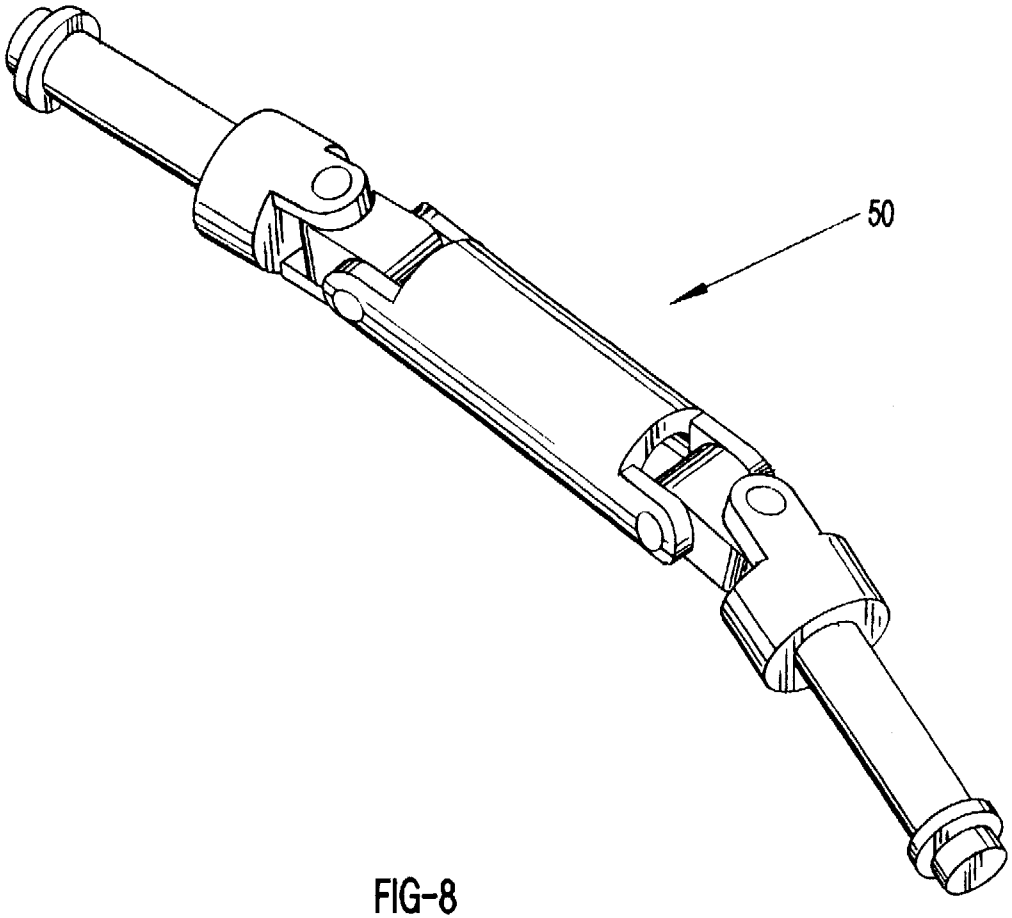
FIG. 8 illustrates the preferred coupler for use in the embodiment of FIG. 7.

Referring to FIGS. 7 and 8, a roller coaster according to the invention may comprise a plurality of carriage and frame assemblies 10,10',10" linked together by couplings 50,50'. Preferable coupling 50 is a U-joint type coupling to provide up to three degrees of freedom, but any couplings known in the art may be employed. Each individual carriage 12 can travel at high speed in the linked set, yet, be independently rotated.

Figure 9:
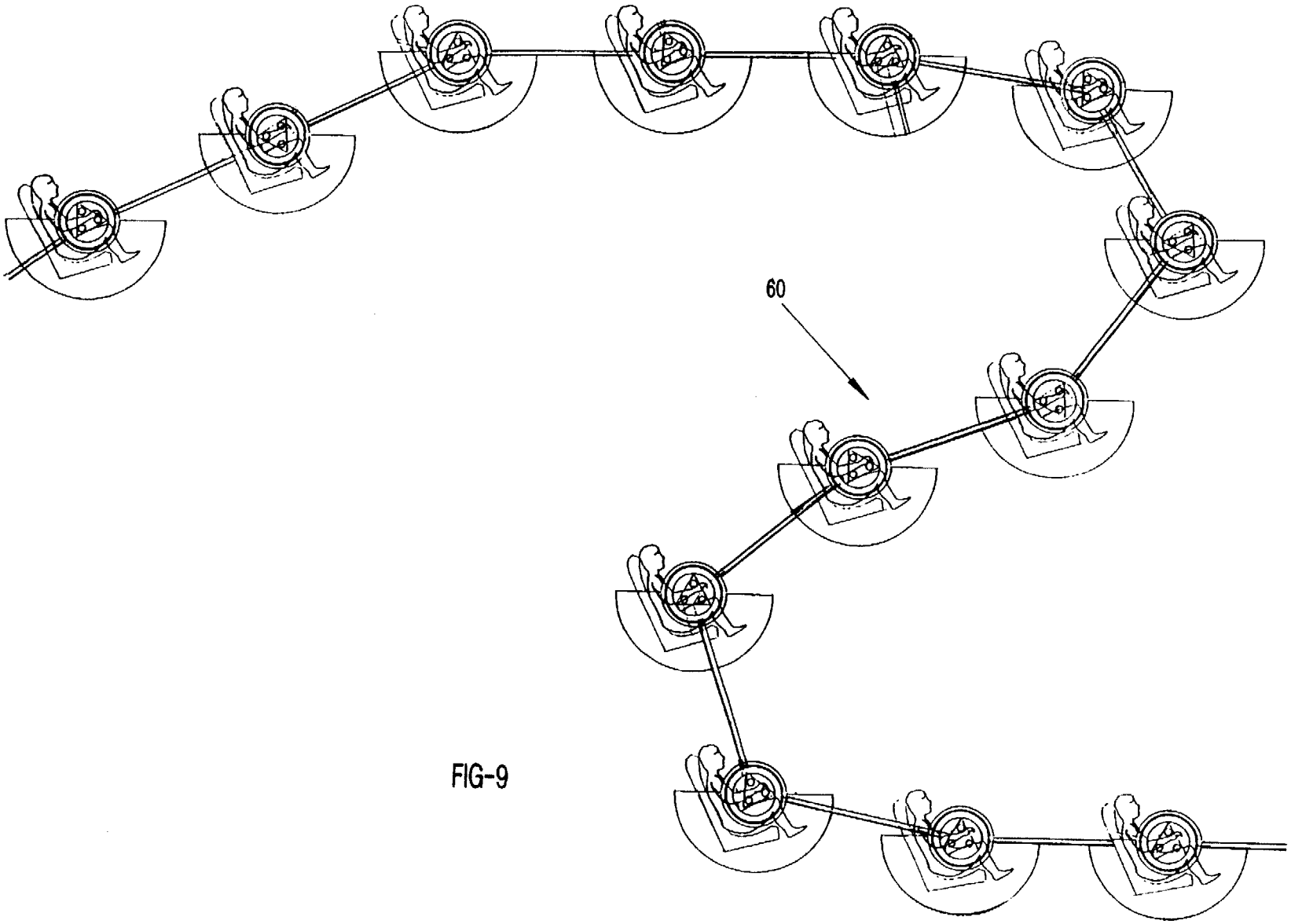
FIG. 9 illustrates a retrograde motion embodiment of the invention and successive positions of the frame and occupant when the frame/carriage brake is not engaged.
Figure 10:
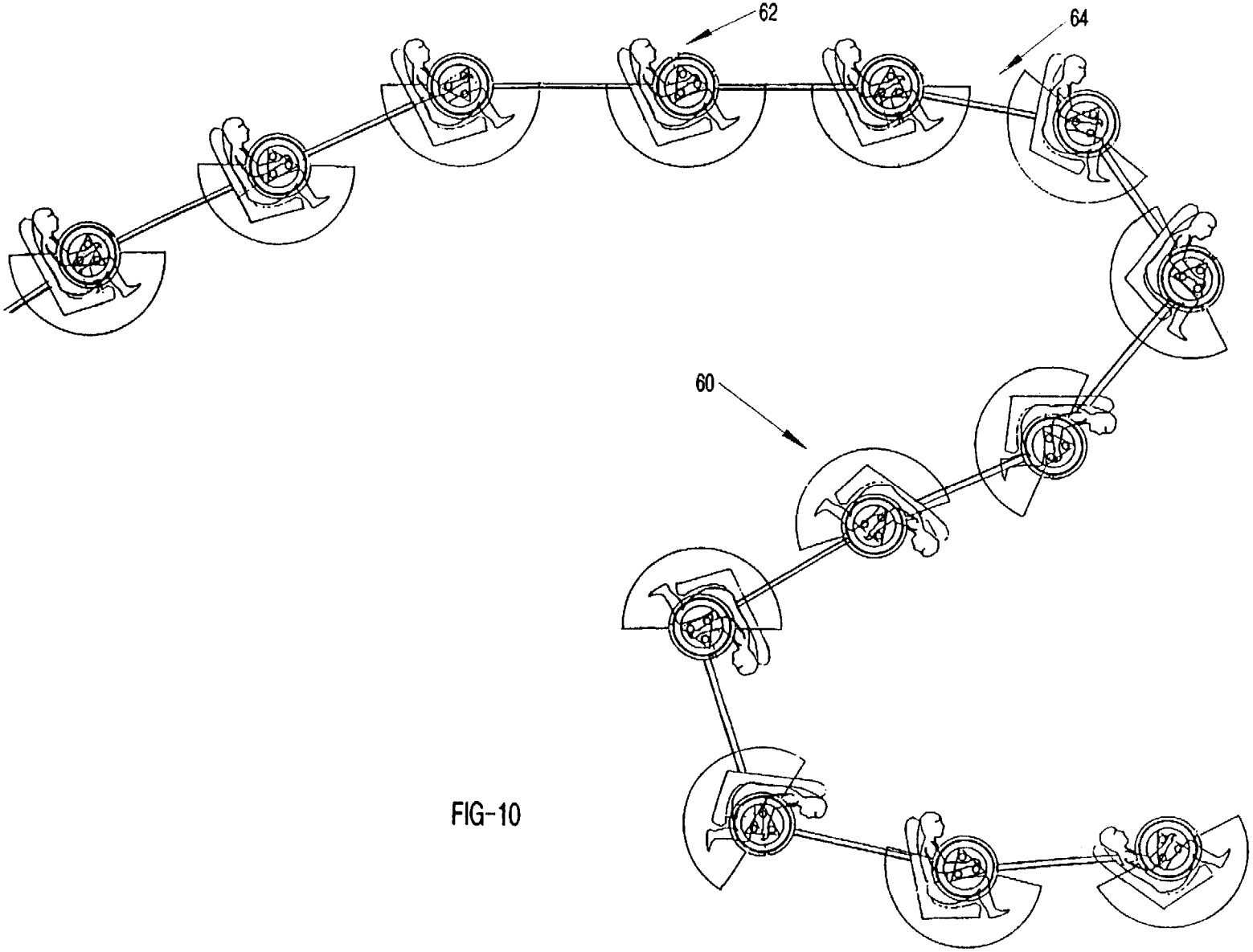
FIG. 10 illustrates a retrograde motion embodiment of the invention and successive positions of the frame and occupant when the frame/carriage brake is engaged.
Figure 11:
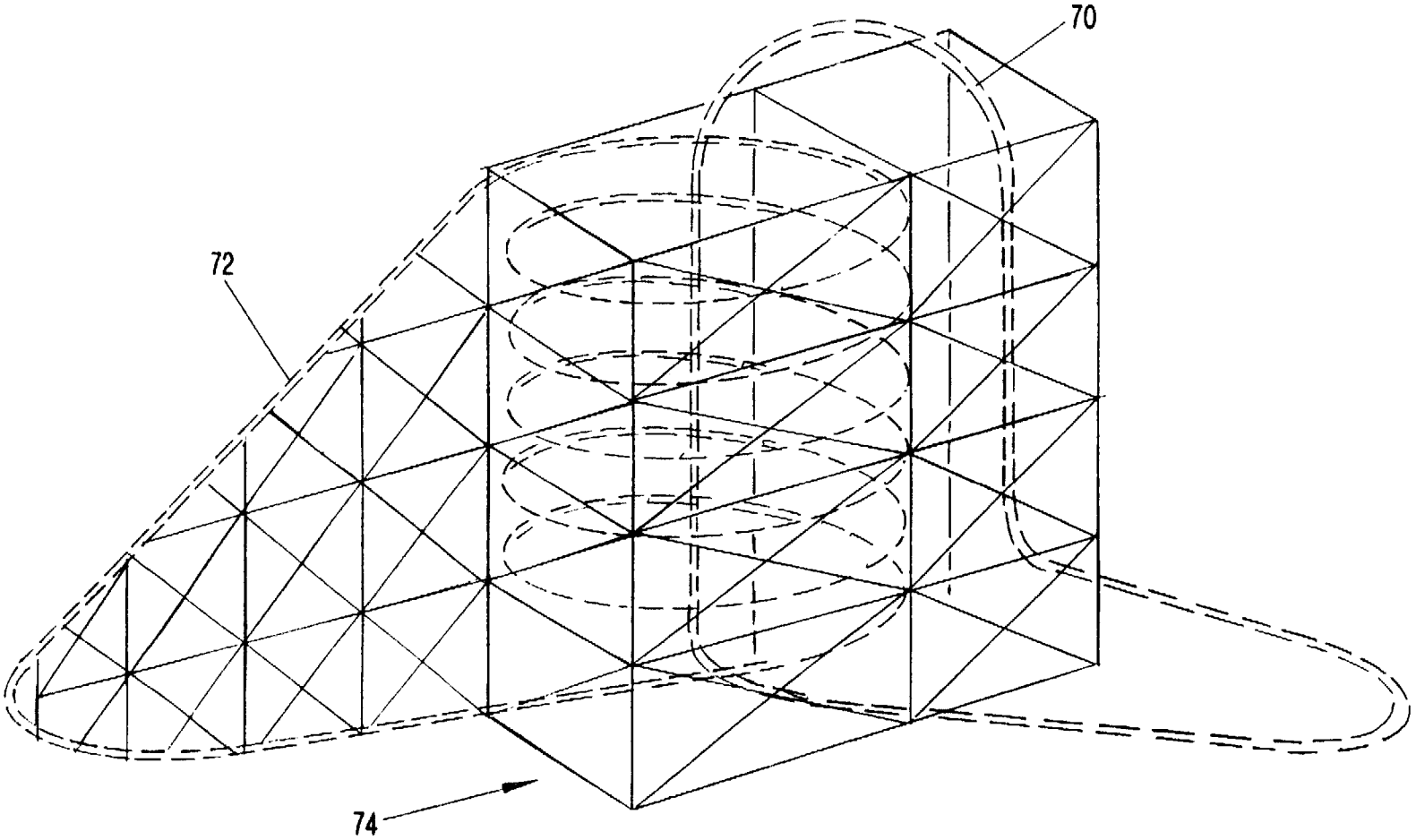
FIG. 11 illustrates an embodiment of the invention in which multiple tracks are provided on a single structure.

FIGS. 9–11 illustrate the use of the invention by one or more riders and the experiences made possible by the invention. FIG. 9 shows the rider at several points in a portion of a roller coaster with a retrograde motion segment 60. The rider is not applying the brake, which permits free rotation of the car so that the rider maintains the same orientation with respect to the ground. Note that this is the type of rotation employed by Ferris wheels in which the passenger always looks forward. FIG. 10 shows the same ride, with the first portion 62 having no brake application and the second portion 64 with the rider having fully or partially engaged the frame/carriage brake, stopping free rotation of the car. The orientation of the rider with respect to the ground changes, including having the rider up-side down, sideways, etc. Since the roller coaster allows the passengers to swing freely or spin with the motion and the direction of the roller coaster, every ride on the roller coaster is a unique experience.

FIG. 11 illustrates the shape of one of many possible roller coasters permitted by the invention, in which there are multiple roller coaster rides 70,72 supportable by a single structure 74. This provides for enhanced excitement of the passengers with increased passenger capacity and throughput. Two such possible rides are shown in FIG. 11, with the first ride 72 forming a spiral and the second ride 70 passing vertically through the spirals 72. As may be readily understood by those skilled in the art, the possibilities permitted over the prior art are essentially endless.

Figure 12:
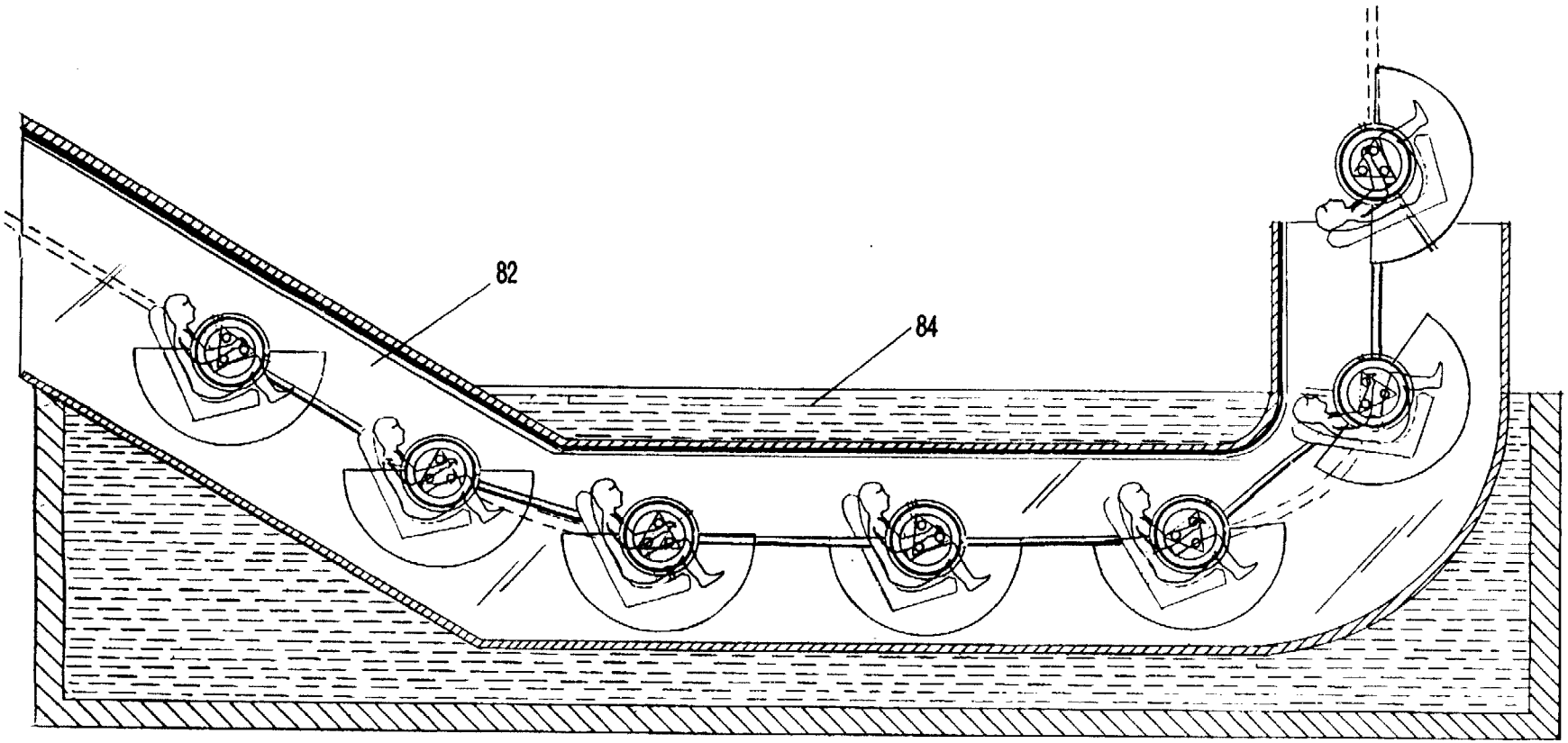
FIG. 12 illustrates an embodiment of the invention in which the track passes through a transparent passage beneath water or other fluid.

FIG. 12 illustrates employment of the invention with a section of transparent passage or tube 82 passing through substance 84. The substance is preferably a fluid, most preferably water or air. In water, the ends of the immersed tube should be above the water line, thereby allowing no water to enter the tube. An aquarium exhibit is one possible application of this aspect of the invention. The substance may also be a transparent, opaque or translucent solid in which lights, designs, models (e.g., wax), and the like are incorporated. The term "tube", as used throughout the specification and claims, means a passage with any cross-sectional shape (e.g., circular, square, rectangular, oval, triangular, etc.).

Figure 13:
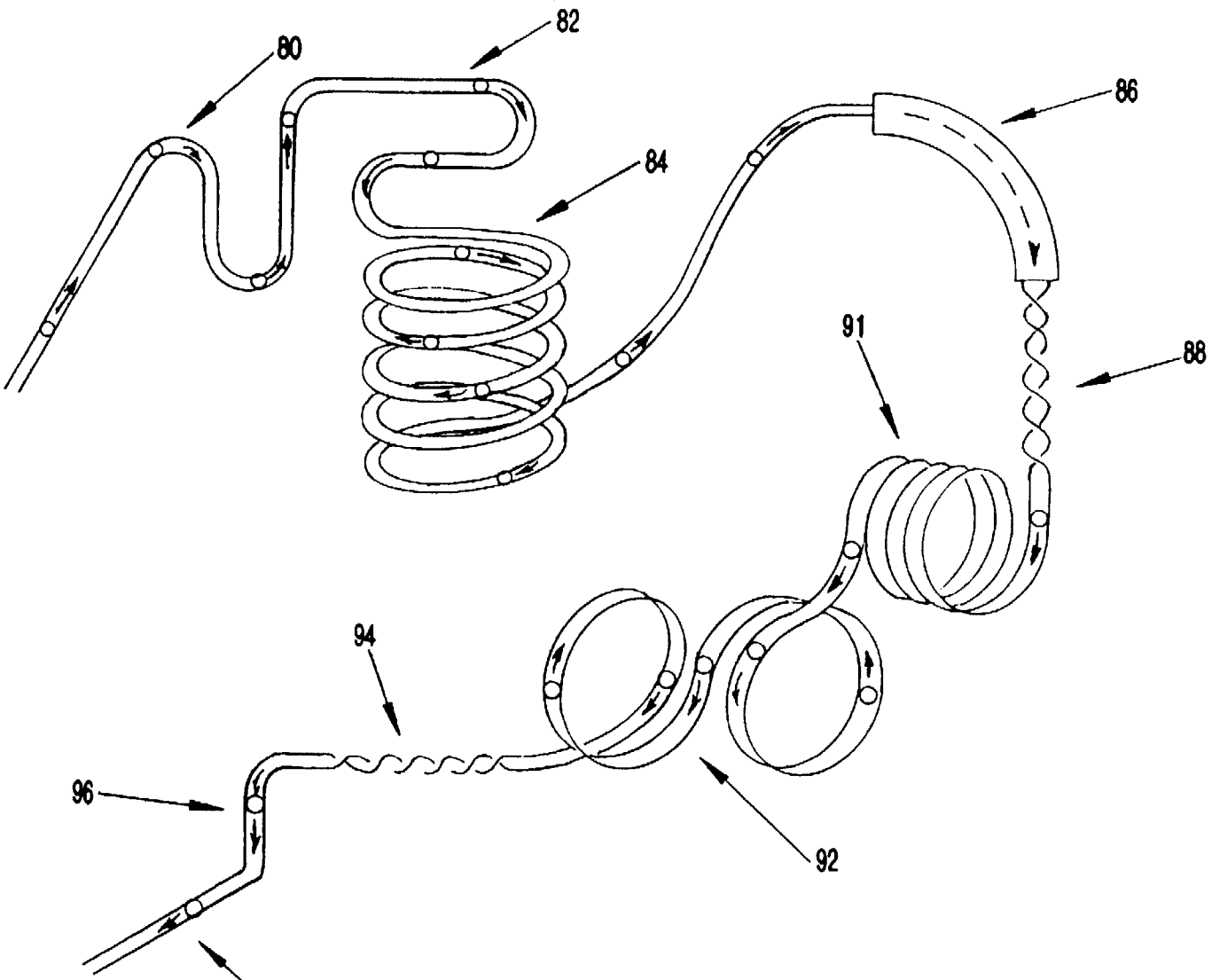
FIG. 13 illustrates one possible ride according to the invention incorporating multiple motions, directions and configurations.

FIG. 13 illustrates a complex roller coaster having multiple configurations, including a vertical "plumber's drain" 80, a horizontal "plumber's drain" 82, a spiral 84, passage through a tube 86, a vertical helix 88, a spiral 91, a reverse loops 92 (inside to outside or outside to inside), a horizontal helix 94, and a free fall 96 going into a retrograde 98. FIG. 13 is not intended to illustrate actual rail placement, but to show a few of the many possibilities for roller coaster rides in accordance with the present invention. As can be seen, any combination of the above (or other) rail structures and configurations can be joined end to end to make an interesting travel pattern. Carriages may even have sufficient forward motion to catapult into free flight and be captured by a tube or funnel arrangement (not shown).

Figure 15:
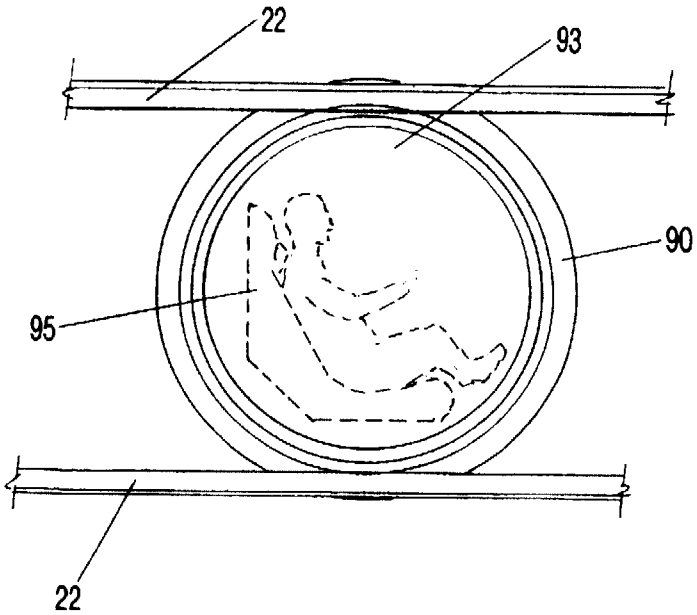
FIG. 15 is a cut-away view of the sphere of FIG. 14.
Figure 14:
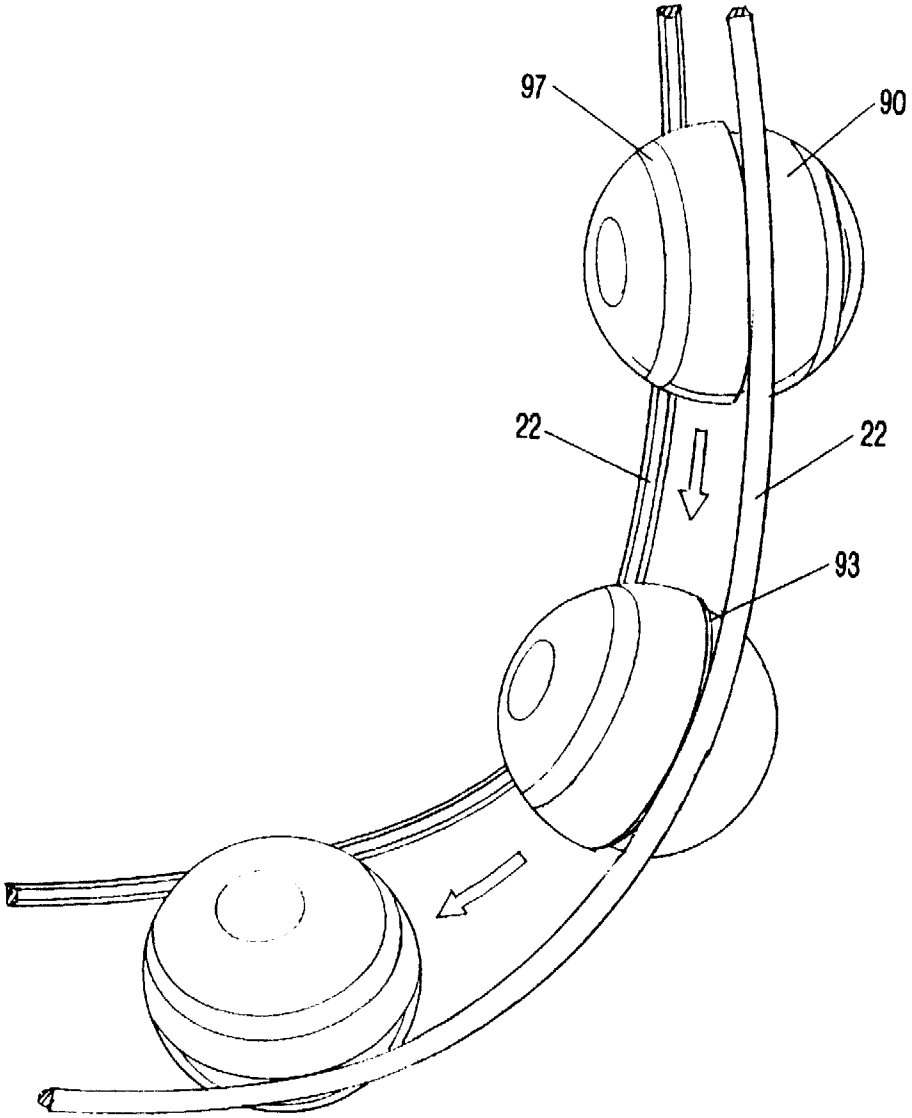
FIG. 14 illustrates an embodiment of the invention in which the carriage comprises a sphere having a circumferential slot or groove engaging the rails.
Figure 16:
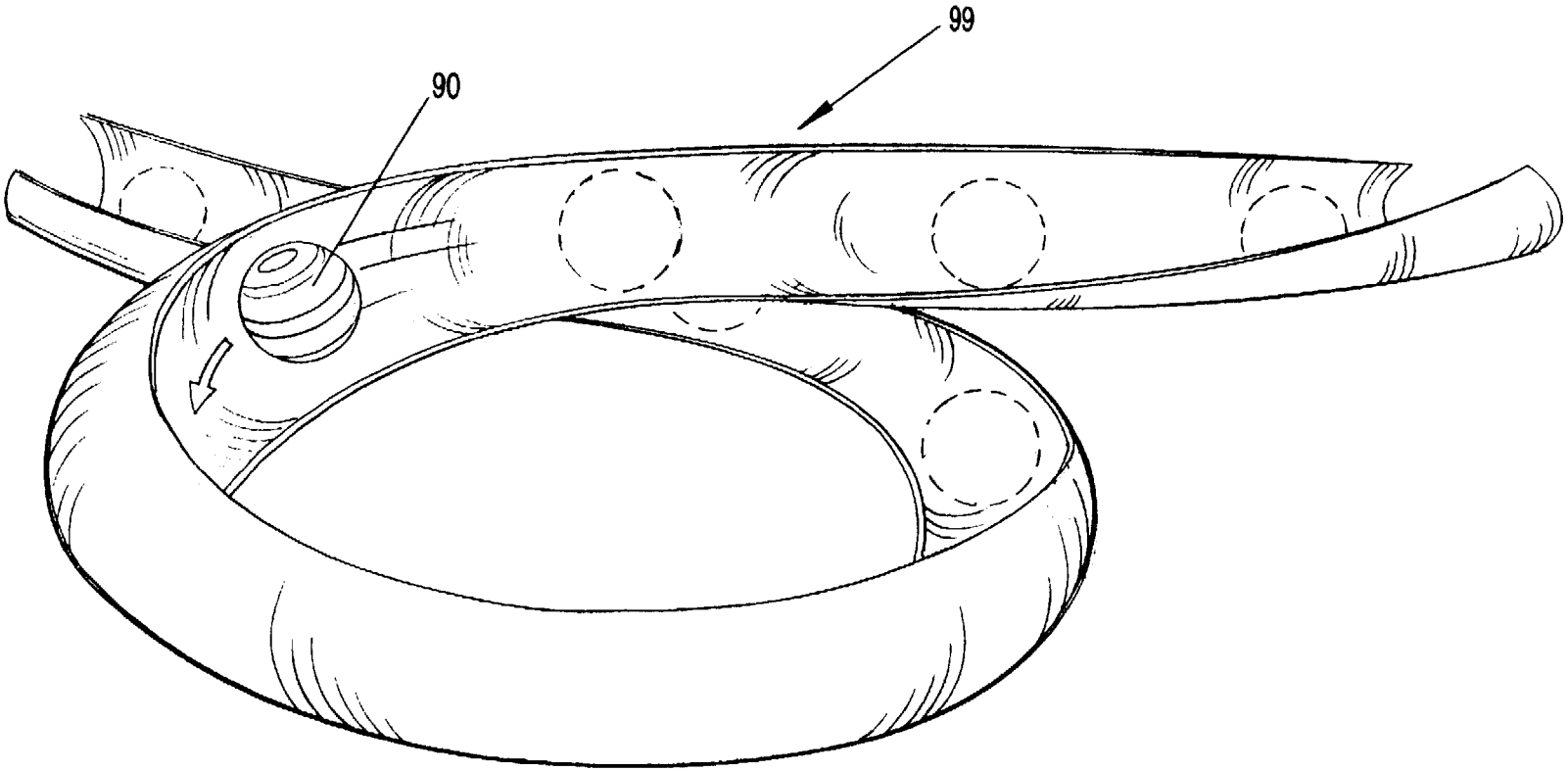
FIG. 16 illustrates an embodiment of the invention in which the sphere of FIG. 15 rolls within a vertical helix, U-shaped track.

FIGS. 14–16 illustrate two alternative embodiments of the invention. An outer sphere 90 comprising circumferential groove or slot 93 which goes 360° around sphere 90 engages parallel rails 22, permitting any possible orientation of the track of the roller coaster. Bearings may be provided between rails 22 and groove 93. Groove and bearings are preferably trapezoidal in shape (not shown) to best accommodate rails. Tracks preferably have a tongue in order to engage the grooved rolling balls. In the event a vertical free fall effect is desired, rails 22 can be separated slightly (e.g., an additional fraction of an inch greater than their normal separation). Rails 22 are brought together at the end of the free fall to normal separation distance in order to catch or regain control over travel of outer sphere 90. In curves or other areas where high gravitational or centrifugal forces are generated by the travel of outer sphere 90, additional rails or an encompassing tube may be used to strengthen rails and to assist in maintaining their distance of separation. If a tube is used, a portion of the tube may have an interior tongue to guide the spheres.

FIG. 15 shows vertical parallel rails 22 (with respect to outer sphere 90) (although horizontal rail or other orientation of rails may be provided). Outer sphere 90 preferably contains inner sphere 93 in which car 95 is placed. Inner sphere 92 rotates freely in all axes within outer sphere 90, via, e.g., fluid or bearings between spheres 90,93, which act to effectively isolate the motion of outer sphere 90 from inner sphere 93, permitting free rotation of the car and the passenger(s) seated therein. The passengers within inner sphere 93 would be able to sit upright regardless of the direction of travel of outer sphere 90 or would be selectively able to activate a brake mechanism between inner sphere 93 and outer sphere 90, which would temporarily lock inner sphere 93 to outer sphere 90 and thereby allow the passengers to spin along the same direction and at the same rate as the motion and roll of outer sphere 90. Only two rails 22 are shown in the drawings, although additional rails (e.g., 3–5 rails) may be provided to engage additional circumferential grooves 97. Alternatively, outer sphere 90 may simply be permitted to roll along a concave or U-shaped track 99 through a bobsled-type run or in an enclosed tube, depending on the attitude, mass, velocity and direction of motion of the sphere(s). The term "spherical" and "sphere", as used throughout the specification and claims are intended to mean a wholly enclosed or wire frame sphere or cylinder or a partial sphere or partial cylinder in which there is a surface opening. If the outer sphere is actually a cylinder shape, then the inner sphere could either be a sphere or a cylinder shape.

In an alternative embodiment, the inner sphere may be weighted so that the passenger(s) remain in an upright seated (or standing) position in ground position. As the rails curve to make the rail structures and configurations discussed herein, the passenger(s) attitude would change as the rails move off ground position. Thus, the passenger(s) experience a limited range of motion rather than a full range of motion in all three planes as the outer sphere spins. If the passenger (s) is seated or standing, weighting and seat configuration may be calculated so as to prevent the passenger(s) looking at his/her feet. Rather, the passenger(s) is able to view "straight ahead." The weighting problem is created because the inner sphere is able to spin freely within the outer sphere. Therefore, the inner sphere may be weighted so the passenger's weight does not force the inner sphere to rotate to afford the passenger a disadvantageous view.

The two spheres (if enclosed) are accessed by doors which follow and maintain the curvature of the two spheres. The outer sphere's door may be hinged to have the door open to the outside. Or, the door acts as a panel which slides within the frame of the outer sphere to open. The inner sphere's door is hinged to open inward or the door slides as a panel. The inner door should be placed in the top half of the inner sphere. Preferably, there is a seal which connects to the inner sphere which acts effectively to scrub the inside of the outer sphere free of the suspending liquid (if liquid is used as a bearing). The seal is connected to the inner sphere. In this way, with the seal, the outer door can be opened and the inner door can be opened to make a connection between the outside of the outer sphere and the inside of the inner sphere. The seal should be sufficiently robust to prevent leaks yet sufficiently soft so as not to rub grooves into the inside of the outer sphere. If the seal is sufficiently robust, the inner sphere may not require a door. The inner sphere may be weighted with the majority of the weight which is placed inside the inner sphere on the bottom of the inner sphere. This will act to keep the inner sphere level as the outer sphere rotates around the inner sphere.

The fluid or liquid between the spheres should have sufficient gravity to be able to cushion the inner sphere from the inside of the outer sphere at all times. The fluid should not be viscous or only slightly viscous as viscosity will act to drag the inner sphere with the rotation of the outer sphere. The fluid should not break down under hot conditions (in case of friction heat building up on the outer sphere) and should have a low freezing point.

The inside of the outer sphere should be almost or perfectly round and smooth. This will ensure that little or no friction build up occurs between the inner and outer spheres. The outside of the outer sphere should be almost or perfectly round and smooth with the exception of a single groove, or multiple grooves, which act to stabilize the outer sphere on its tracks or inside a tube.

The outer surface of the inner sphere should be almost or perfectly round and smooth with the exceptions of: 1) the inner door seal; 2) a cushion on the bottom of the outside of the inner sphere (a cushion may, or may not, be necessary as an added shock absorbing device in the event the inner sphere is loaded past the capacity of the fluid to keep the inside of the outer sphere from rubbing against the outside of the inner sphere); and 3) cushions may be required on multiple sides of the inner sphere, including directly opposite the door seal, in order to provide protection against friction between the inner sphere and the outer sphere.

The inside of the outer sphere may have a magnetic strip (possibly superconducting) or strips that, when charged, would set up a magnetic field. The inside sphere may have a corresponding magnetic strip(s) that would be attracted to the strip(s) on the outer sphere when the outer sphere's strip(s) is magnetically charged. This system acts to align the two spheres so that the two doors will align. It is advantageous if the strip(s) on both spheres are transparent. The magnetic strip(s) on the outer sphere should be magnetized at certain locations when a person would want to provide ingress or egress to the inner sphere. This could be done by setting up the magnetic field at those points (locations).

The spheres are preferably made of very strong materials, sufficient to absorb impacts and centrifugal forces as the outer sphere travels along the track or inside a tube. Plexiglass or some derivative in sufficient thickness is useful in accordance with the invention. If passengers are to be transported inside the inner sphere, both spheres should be substantially made of transparent material so the passenger can view the terrain or the inside of the tube or track. The tube or track can be transparent, as well.

Tracks or rails are preferably made of steel or some other strong material. Tracks are preferably held together by a system of supporting beams, rings, rods, and rails. Tracks may lie on a bed or can be suspended overhead.

Switching from track to track or track to tube, etc., may be accomplished by a set of points and frogs on the track or in a tube, much like a modern railroad. Or, switching can be accomplished by using doors which open and close. Propulsion of the carriages may be accomplished in several manners, including: 1) air blast (gas could either be compressed and released or gas pressure could be generated by a fan, jet, or rocket; 2) spring (initial propulsion can be achieved using a spring (coiled and released behind the carriage)); and 3) mechanical push device (e.g., chain driven, similar to a typical roller coaster chain drive). Secondary or assistive propulsion can also be accomplished by using gas, spring or mechanical push devices along the path of the carriage once the carriage is initially launched.

Eventually, the carriage must come to rest. Carriage braking may be accomplished by e.g., reverse gas propulsion, friction rollers placed inside the track or tube, an uphill climb, and the like.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application(s), are hereby incorporated by reference.

What is claimed is:

1. An amusement device comprising:

a seating means for seating at least one passenger riding said amusement device;

a frame for supporting said seating means;

an axle attached to a carriage, said frame attached to and fully rotatable about said axle;

track means comprising a configuration allowing said carriage to travel in any direction of horizontal, vertical, angled, retrograde, curved, curvilinear, and combinations thereof; and carriage contact means for disposing said carriage on said track means;

said frame fully rotatable about said axle and at substantially a center of gravity of said frame and said seating means; and a passenger control means for selectively allowing or preventing free rotation of said frame about said axle.

2. The amusement device of claim 1 wherein said seating means comprises a restraint for restraining the passenger through motions in all three planes in said seating means.

3. The amusement device of claim 2 wherein said restraint comprises at least one rigid bar.

4. The amusement device of claim 2 wherein said restraint comprises at least one strap.

5. The amusement device of claim 2 wherein said seating means comprises seats for multiple passengers.

6. The amusement device of claim 1 wherein said carriage contact means comprises at least one set of wheels and said track means comprises a rail disposed between said wheels of said at least one set of wheels.

7. The amusement device of claim 6 wherein said wheels are concave-shaped and said rail is tubular.

8. The amusement device of claim 1 wherein said passenger control means comprises a brake system for braking rotation of said seating means about said axle.

9. The amusement device of claim 8 wherein said brake system is activated by at least one passenger.

10. The amusement device of claim 9 wherein said brake system is activated only by more than one passenger.

11. The amusement device of claim 10 wherein said brake system is activated only by a mojority of passengers.

12. The amusement device of claim 9 wherein said brake system comprises a passenger pull lever, a disk brake, and calipers which engage with said disk brake when the passenger pulls on said lever.

13. The amusement device of claim 8 wherein said brake system is automatically activated by motor means.

14. The amusement device of claim 12 wherein said motor means is programmable.

15. The amusement device of claim 1 wherein said seating means comprises at least one seat contoured to the shape of the passenger.

16. The amusement device of claim 1 wherein said carriage connects to other carriages by rotatable couplers.

17. The amusement device of claim 16 wherein said rotatable couplers allow for three degrees of rotational freedom.

18. The amusement device of claim 16 wherein said rotatable couplers comprise linked u-joints.

19. The amusement device of claim 1 further comprising a clear tube in which at least a portion of said track means is disposed.

20. The amusement device of claim 19 wherein said clear tube is surrounded by a fluid.

21. The amusement device of claim 19 wherein said clear tube is surrounded by a solid.

22. The amusement device of claim 1 comprising at least two track systems, each of said track systems supporting an independent ride.

23. The amusement device of claim 22 wherein at least one track system comprises a spiral rail system and at least one other said track system comprises a rail system vertically disposed within said spiral rail system.

24. An amusement device comprising:

seating means for seating at least one passenger riding said amusement device;

a frame for supporting said seating means;

an axle about which said frame is freely rotatable, said axle being attached to a carriage;

a brake system connected to at least one of said frame and carriage, said brake system including a plurality of passenger pull levers, disk brakes, and calipers which engage said disk brakes when passengers pull on respective ones of said pull levers;

track means comprising a configuration allowing a carriage supporting said frame and seating means to travel in any direction of horizontal, vertical, angled, retrograde, curved, curvilinear, corkscrewed, looped, and combinations thereof; and carriage contact means for disposing said carriage on said track means; and wherein said frame is fully rotatable about said axle and at substantially a center of gravity of said frame and said seating means.

* * * * *